United States Patent [19]

Healey

[11] Patent Number: 4,682,448

[45] Date of Patent: Jul. 28, 1987

[54] SHELTER

[75] Inventor: Brian J. Healey, Charlestown, Mass.

[73] Assignee: Fiberlock Technologies, Inc., Cambridge, Mass.

[21] Appl. No.: 842,672

[22] Filed: Mar. 21, 1986

[51] Int. Cl.[4] ..... E04B 1/347; E04H 15/02

[52] U.S. Cl. ..... 52/63; 135/108; 135/117; 135/900

[58] Field of Search ..... 135/117, 901, 108, 900; 52/63

[56] References Cited

U.S. PATENT DOCUMENTS

| | | | |
|---|---|---|---|
| 3,265,059 | 8/1966 | Matthews | 135/117 X |
| 3,352,313 | 11/1967 | Kroening | 135/117 X |
| 3,896,831 | 7/1975 | Feldman et al. | 135/117 X |
| 4,000,749 | 1/1977 | Busco | 135/117 |
| 4,067,346 | 1/1978 | Husted | 135/901 X |

*Primary Examiner*—J. Karl Bell

*Attorney, Agent, or Firm*—Robert T. Gammons

[57] ABSTRACT

A shelter for interior use within living space, office space or working space defining an enclosure extending from the floor to the ceiling and providing access through a ceiling opening for above-ceiling construction and/or repair while containing debris engendered as a consequence of such activities and/or falling objects.

1 Claim, 7 Drawing Figures

SHELTER

BACKGROUND OF THE INVENTION

Not infrequently, it is necessary to provide above-ceiling construction and/or repair work in homes, offices, and working areas without exposing the occupants to falling debris and/or objects and to harmful material. Accordingly, it is the purpose of this invention to provide a shelter which can be installed in the space between the floor and ceiling where the work is to be performed above the ceiling which will exclude debris and other harmful substances from falling into and/or entering the surrounding space while at the same time providing access to the opening for the purpose of construction and/or repair.

SUMMARY OF THE INVENTION

As herein illustrated and in accordance with the invention, a shelter is provided in the form of an enclosure of rectangular cross section and of a height to extend from the floor to the ceiling, said shelter comprising a bottom part, a top part and a connecting wall which collectively define a closed chamber, means defining an entrance to the chamber in the wall thereof comprising an opening in the wall and a panel coextensive with the opening and means for releasably securing the panel in said opening in the wall, said opening being of a size to permit one to enter the enclosure, means defining an exit from the enclosure through the top part comprising an opening in the top part, a closure panel coextensive in area with the opening in the top part and means for releasably securing the closure panel in said opening in the top part, said opening being of a size to permit one to leave the chamber through the top part. Further in accordance with the invention, there is vacuum generating means connected to the chamber for providing a pressure in the chamber lower than the surrounding ambient pressure. The fastening means in the preferred form comprise zipper assemblies for releasably securing the closure panels. Desirably, the enclosure is mounted on a caster-supported platform to enable movement from one position to another and is extendible in height to accommodate it to the ceiling height from the floor. The enclosure is comprised of a flexible material and a frame is provided for supporting the enclosure distended in the configuration defined by its top, bottom and side walls. Desirably, the side wall is translucent and the top wall is transparent.

The invention will now be described in greater detail with reference to the accompanying drawings, wherein.

FIG, 7 is an elevation of an alternative form of supporting frame.

Figure 1:
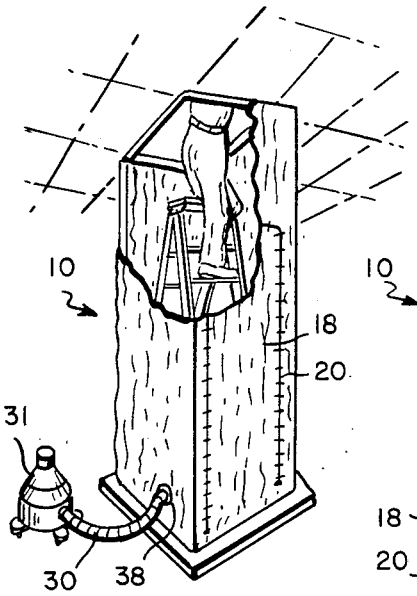
FIG. 1 is a perspective of the shelter disposed between the floor and ceiling.
Figure 2:
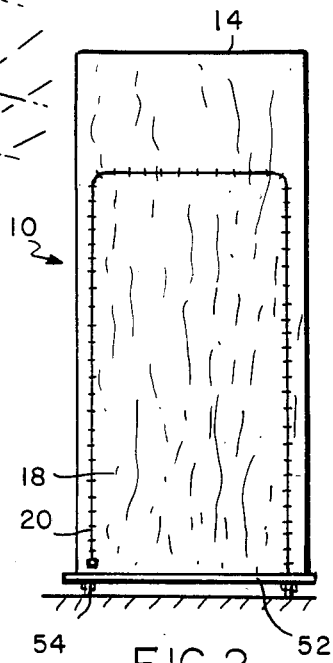
FIG. 2 is a front elevation.
Figure 3:
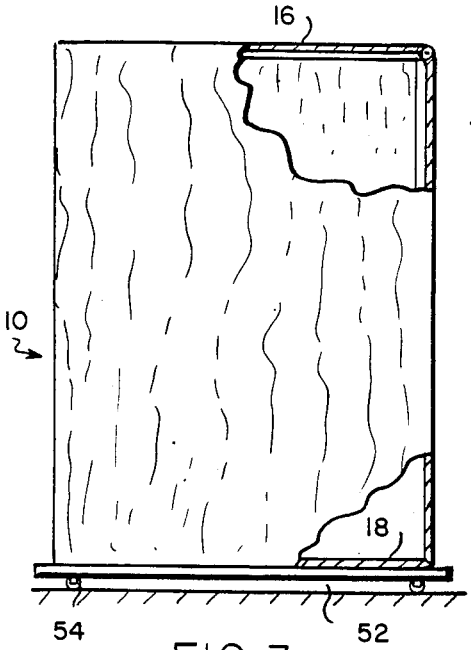
FIG. 3 is a side elevation.

Referring to the drawings, FIGS. 1 and 2, the shelter 10 is in the form of a cubicle enclosure of rectangular cross section comprising spaced, parallel side walls 12—12, spaced, parallel end walls 14—14, a top wall 16 and a bottom wall 18. The enclosure 10 is comprised of a flexible material and, desirably, the side walls are comprised of translucent material and the top wall of transparent material. The bottom wall may be of opaque material, although it is within the scope of the invention to use the same material for the bottom wall as the side walls.

Figure 4:
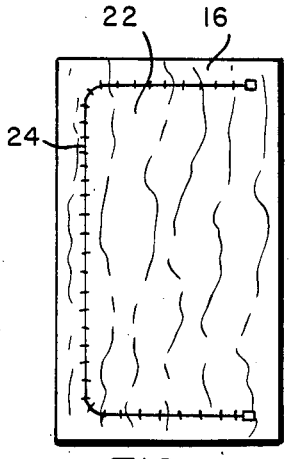
FIG. 4 is a top plan view showing one form of enclosure.

In one end wall 14, there is a seperable closure panel 18 seperably secured to the end wall 14 by zipper fastening means 20 of conventional construction. The top wall 16, FIG. 4, contains a separable closure panel 22 separably connected to the top wall by zipper fastening means 24. The aforesaid enclosure is dimensioned to be placed between the floor and ceiling of a building and is of a size to enable placing a stepladder within the enclosure as illustrated in FIG. 1 to thus enable a worker to enter the enclosure and ascend the ladder for entrance through an opening in the ceiling. Desirably, the top to bottom dimensions of the side walls are such as to enable extending the shelter for use in a low ceiling room to use in a high ceiling room.

Figure 5:
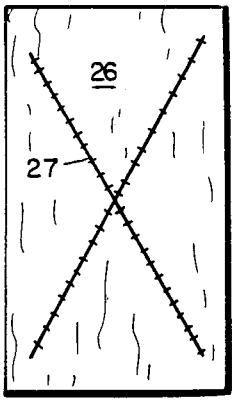
FIG. 5 is a top plan view showing another form of enclosure.

While the closure panel 18 is shown as having a rectilinear upper end, it is within the scope of the invention to have an arcuate upper end and while the enclosure 24 in the upper wall 16 is shown to be generally U-shaped and hinged along one side, it may comprise triangular panels 26 defined by diagonals 27 as shown in FIG. 5.

One wall 12 of the enclosure, FIG. 1, contains an opening 28 for receiving one end of a hose 30, the other end of which is connected to a vacuum apparatus as, for example, a vacuum cleaner 31 by means of which a low pressure may be maintained in the enclosure.

Figure 6:
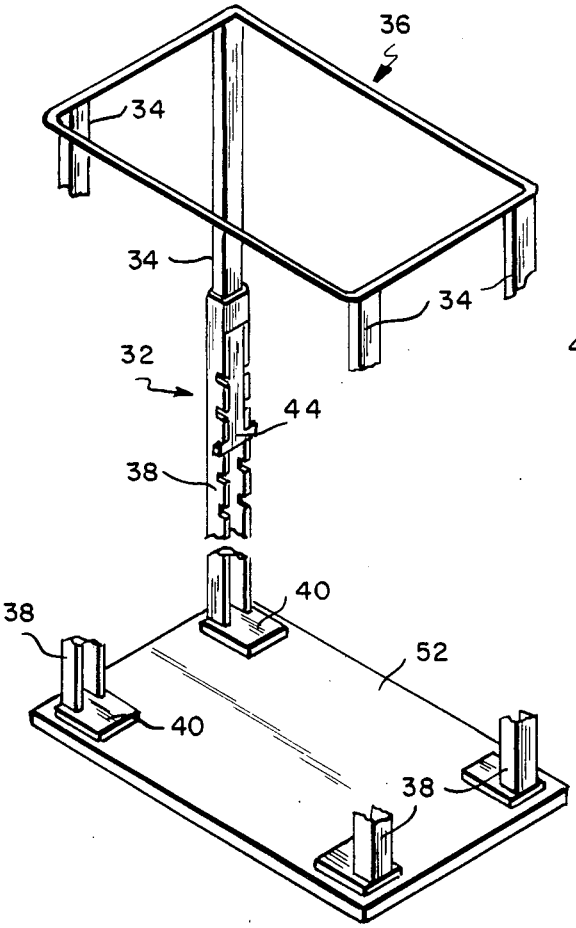
FIG. 6 is a perspective of a supporting frame.
Figure 7:
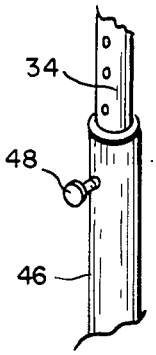

The enclosure is supported in its distended form between the floor and ceiling by means of a frame 32, FIG. 6, comprising four columns 34, to the upper ends of which are fixed a rectangular frame 36 corresponding in cross section to the inside cross section of the enclosure. The lower ends of the columns 34 are adjustably mounted within sleeves 38 fixed to the foot plates 40. The sleeve 38 contain vertically-spaced notches 42 for receiving the ends of T bars 44 which enables adjusting the columns 34 heightwise. Alternatively, FIG. 7, the columns 34 may be telescopically received in the upper ends of pipes 46 within which they are adjustably supported by screw bolts 48 threaded through the pipes 46 into engagement with the column 34.

The lower ends of the posts 38 or supports 46 may rest directly on the floor. However, to facilitate mobility, the lower ends are mounted to the corners of a rectangular platform 52 supported at its underside by casters 54.

Extension of the enclosure is made possible by constructing the side walls of a length to match the height of the highest room that might be expected and accommodating it to rooms of lesser height by allowing the lower part of the side walls to fold or pleat at the base.

Desirably, the enclosure is 3 feet by 5 feet and of a height to accommodate an 8 foot step ladder. The bottom wall is comprised of a vinyl approximately 20 mils in thickness, the top wall a clear, transparent vinyl approximately 12 mils in thickness and the side walls are a vinyl which is fire-resistant and approximately 8.5 mils in thickness.

It should be understood that the present disclosure is for the purpose of illustration only and includes all modifications or improvements which fall within the scope of the appended claims.

What is claimed is:

1. A mobile isolation module in the form of a cubicle enclosure of rectangular, horizontal and vertical cross section comprising a bottom wall, a top wall and quadrilaterally-disposed side walls which collectively define a closed chamber, one of said side walls containing a rectangular opening for entrance into the chamber, a panel of corresponding rectangular configuration disposed in said opening, zipper fastener means connecting the panel within said opening to provide access through said opening to the enclosure and to seal the enclosure when in use, means providing an opening in the top wall for exit from the chamber at the top, comprising quadrilaterally-arranged panels formed in the top wall of triangular configuration, the adjacent sides of which are diagonal to the top and the apices of which meet at the center of the top, zipper fastening means joining the adjacent edges of the panels such as to enable variably disconnecting the adjacent edges of the panels to provide an opening at the top of adjustable size, vacuum generating means connected to the chamber through one side wall to enable lowering the pressure therein, a mobile platform, an adjustable frame comprised of quadrilaterally-disposed posts fixed at their lower ends to the platform upon which the enclosure is disposed, said frame being adjustable heightwise to a height corresponding to the height of the ceiling and said side wall panels being comprised of flexible material of a sufficient length heightwise of the module to be extended by adjustment of the frame to the ceiling height and means for mobilizing the platform and, hence, the module, comprising casters mounted to the platform at the four corners.

* * * * *